US005524438A

United States Patent [19]

Johnson et al.

[11] Patent Number: 5,524,438

[45] Date of Patent: Jun. 11, 1996

[54] SEGMENTED BULKHEAD LINER FOR A GAS TURBINE COMBUSTOR

[75] Inventors: Thomas E. Johnson, Manchester; Thomas J. Madden, Vernon; Robert W. Soderquist, Windsor, all of Conn.

[73] Assignee: United Technologies Corporation, Hartford, Conn.

[21] Appl. No.: 356,599

[22] Filed: Dec. 15, 1994

[51] Int. Cl.[6] ..... F02C 1/00

[52] U.S. Cl. ..... 60/747; 60/752

[58] Field of Search ..... 60/752, 755, 756, 60/744, 39.31, 39.32

[56] References Cited

U.S. PATENT DOCUMENTS 4,414,816 11/1983 Craig et al. ..... 60/757

4,870,818 10/1989 Suliga ..... 60/756

4,914,918 4/1990 Sullivan ..... 60/756

*Primary Examiner*—Timothy S. Thorpe

*Attorney, Agent, or Firm*—Edward L. Kochey, Jr.

[57] ABSTRACT

Truncated pie shaped bulkhead liner sections 60 are each divided into two liner segments 62. The division occurs adjacent fuel nozzle opening 20. Upstream extending lips 71, 75 and 77 abut the bulkhead 14. Cooling air passes through cooling flow openings in the bulkhead with all the flow continuing toward the shell 38, 40 edges of the liner segments.

1 Claim, 2 Drawing Sheets

SEGMENTED BULKHEAD LINER FOR A GAS TURBINE COMBUSTOR

TECHNICAL FIELD

The invention relates to the upstream bulkhead end of a gas turbine engine combustor and in particular to a liner construction for protecting the bulkhead from combustor radiation.

BACKGROUND OF THE INVENTION

The bulkhead conventionally forms the upstream end of a combustor in a gas turbine engine. The bulkhead is protected by a bulkhead liner. This is formed in sections, the number corresponding to the number of fuel nozzles passing through the bulkhead and liner. Conventionally a single truncated pie shaped section extends from the inner shell to the outer shell with a central opening for the passage of fuel nozzles. The narrow part between the edges of the section and the opening has been found to crack in the high temperature environment of the combustor.

Cooling air which is impinged from behind the liner is established with a predicted exit flowpath to achieve proper cooling of the liner. If the liner section cracks the cooling air leaks from that location and fails in accomplishing its overall cooling obligations. The liners are also coated with the protective coating to resist the high temperature radiation. A crack edged however is not so protected and leads to rapid disintegration of the liner.

SUMMARY OF THE INVENTION

The gas turbine engine has an annular bulkhead at the upstream end of the combustor. There are a plurality of truncated pie shaped bulkhead liner sections with each section having an opening for the insertion of a fuel nozzle therethrough. Each section is formed of two segments, the division between the two segments being adjacent to the opening.

Each segment has two side edges abutting circumferentially adjacent segments, an inboard edge abutting the opening as well as the other segment forming a respective section and an outboard edge remote from the inboard edge. A plurality of cooling air openings through the bulkhead direct cooling air flow against the upstream side of the segments. An upstream extending lip along the two side edges and a lip along the inboard edge are in contact with the bulkhead, so that substantially all the cooling air directed against each of the segments exits along the outboard edge.

DESCRIPTION OF THE PREFERRED EMBODIMENT

Figure 1:
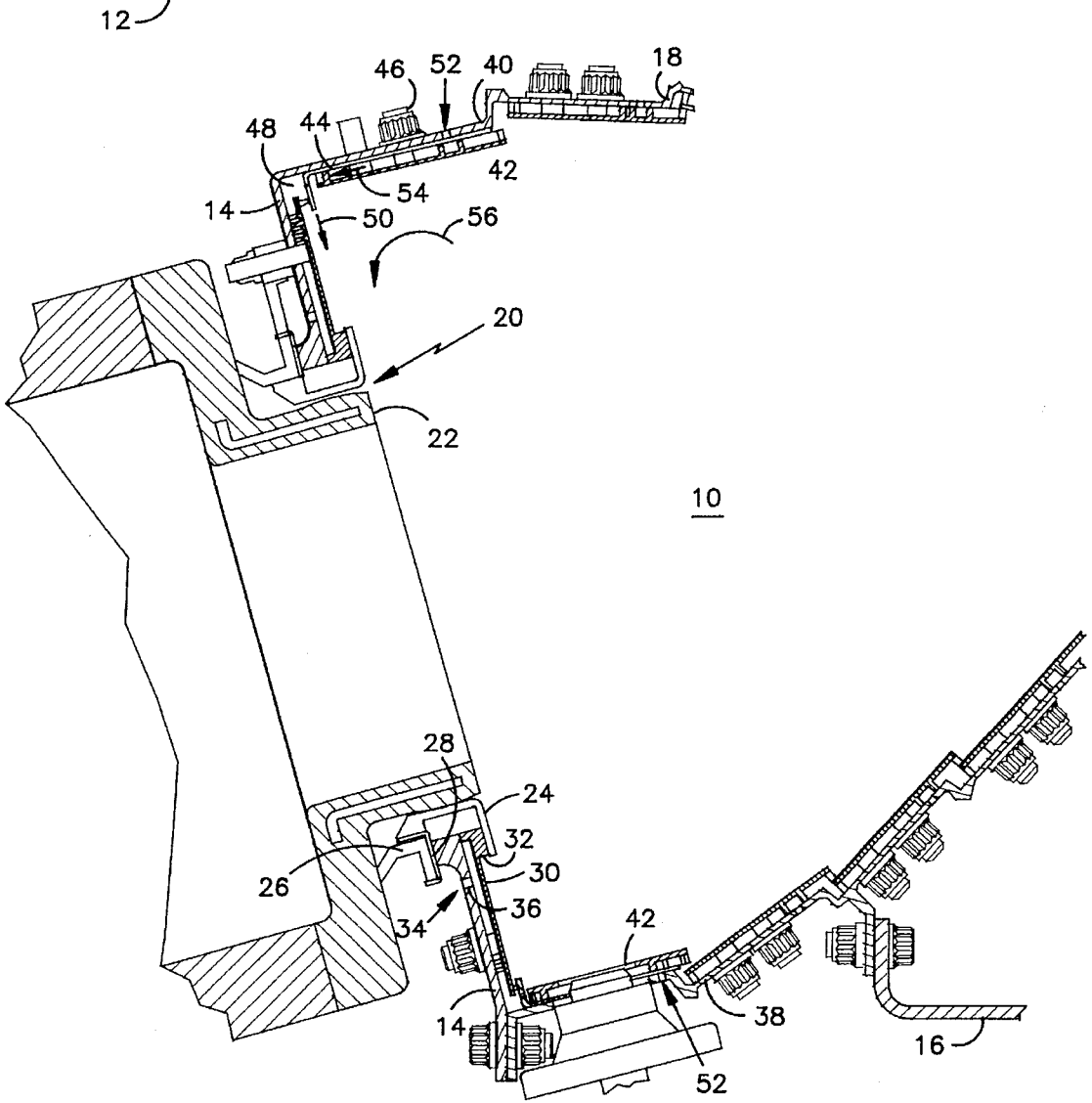
FIG. 1 is a section view through an annular combustor.

FIG. 1 shows an annular gas turbine combustor 10 and the centerline 12 of the gas turbine engine. The conical bulkhead 14 is supported from support structures 16 and 18. Sixteen gas turbine nozzle openings 20 are located around the circumference of the bulkhead.

A plurality of fuel nozzles 22 are locatable within these openings. These nozzles are preferably of the low $NO_x$ type with premixing of fuel and air for low temperature combustion. At each opening there is a fuel nozzle guide 24 which is axially restrained with fuel nozzle guide retainer 26. The key washer 28 prevents rotation of the fuel nozzle guide retainer 26 after installation.

The fuel nozzle guide 24 and the retainer 26 are secured to contain between them the key washer 28, the bulkhead 14 and the bulkhead liner 30. Good contact 32 is maintained between the guide and the liner segments to avoid any significant amount of air passing therethrough. Similarly good contact is maintained on both sides of the key washer 28 to prevent significant air flow past the washer.

The cooling air flow 34 passes through a plurality of openings 36 in the bulkhead impinging against the bulkhead liner 30, with the air passing behind the liner in a direction away from the location of fuel nozzle 22.

An outer shell 38 and an inner shell 40 define the boundaries of the combustor and have bolted thereto a plurality of float wall liner panels 42 at the upstream end of the combustor. A fairing 44 is entrapped between the adjacent shell and the liner panel 42. A plurality of studs and bolts 46 removably secure this structure.

The cooling air flow passing toward the shells and between the bulkhead and the bulkhead liner flows toward the corner area 48 where it turns and is guided in direction 50 along the bulkhead liner.

Cooling flow 52 passing through the inner shell and the outer shell impinges against the liner 42 with the portion of this flow passing as flow 54 toward corner 48 where fairing 44 also deflects it toward the fuel nozzle. The recirculating type flow 56 desired within the combustor is not disturbed by the direction of flow 50 which cools the bulkhead liner.

Figure 2:
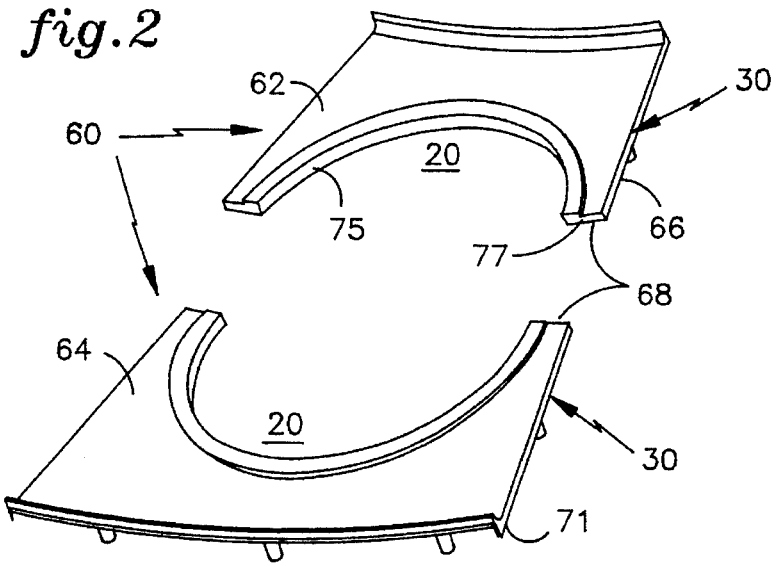
FIG. 2 is an isometric view of the combustor side showing the two segments of one section of liner.

FIG. 2 shows the bulkhead liner 30 with section 60 formed of two segments. There is an inboard segment 62 and an outboard segment 64. The section is divided to form these sections where the opening 20 is closest to the edge 66 of the section, and therefore along the short edge 68.

Figure 3:
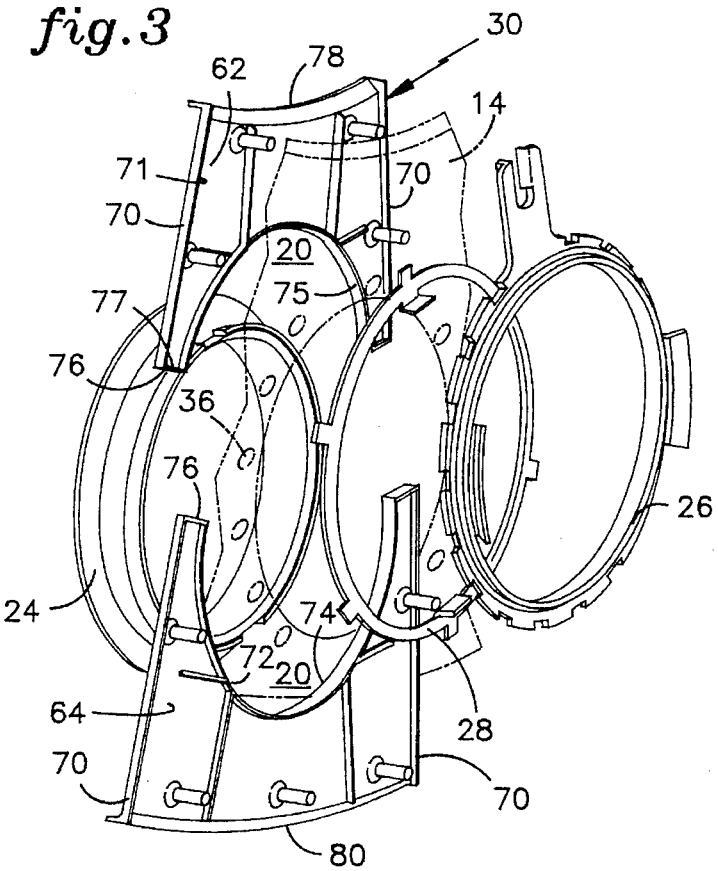
FIG. 3 is an exploded view showing the cold side of the two segments of one section of the liner.

As better shown in FIG. 3 the segments each have two side edges 70 with lips 71 which abut circumferentially adjacent segments. They have an inboard edge 72 which has a portion 74 abutting the opening and a portion 76 abutting the other segment forming the respective section. Portion 74 has lip 75 and portion 76 has lip 77.

The plurality of openings 36 in the bulkhead 14 (also being shown in FIG. 1) permit cooling air to impinge against the cold side of the combustor liner segments 62. The lips 71,75 and 77 of edges 70, 74 and 76 abut the bulkhead 14. The airflow impinging against the cold side of the liner therefore flows outwardly away from the fuel nozzle opening toward the inner edge 78 and the outer edge 80 where it exits into the combustor adjacent the inner and outer shells. Extended surface (not shown), such as pins, may be located on the cold side of the liners to improve the cooling.

Accordingly it can be seen that there is no unexpected leakage of air out of the area now closed by edge 76 because of cracking of the liner. Furthermore, the high temperature coating is applied and the coating surface is not lost by later cracking. This narrow portion of the liner section is where cracks would be expected to occur, in the absence of the split design. Air loss and exposed untreated surface would reduce life.

What is claimed is:

1. In an annular gas turbine engine combustor having an annular bulkhead at an upstream end of said combustor:

a plurality of truncated pie shaped bulkhead liner sections;

each section having an opening for the insertion of a fuel nozzle and formed of two segments and having a division between said sections, the division between two segments being adjacent said opening;

each segment having two side edges abutting circumferentially adjacent segments, an inboard edge abutting said opening and the other segment forming each said section, and an outboard edge remote from said inboard edge, each said segment having an upstream side facing said bulkhead;

a plurality of cooling air openings through said bulkhead for directing cooling air against the upstream side of said segments; and an upstream extending lip along the two side edges and the inboard edge in contact with said bulkhead, whereby substantially all the cooling air directed against each said segment exits at the outboard edge.

* * * * *